United States Patent [19]

Niestroj et al.

[11] 4,137,487

[45] Jan. 30, 1979

[54] METHOD AND DEVICE FOR AUTOMATICALLY LEVELING FLEECES, SLIVERS, ROVINGS AND THE LIKE BY DRAWING

[75] Inventors: Heinrich Niestroj, Ingolstadt; Peter Denz, Hohenwart, both of Fed. Rep. of Germany

[73] Assignee: Schubert & Salzer, Ingolstadt, Fed. Rep. of Germany

[21] Appl. No.: 726,737

[22] Filed: Sep. 27, 1976

[30] Foreign Application Priority Data

Oct. 2, 1975 [DE] Fed. Rep. of Germany ..... 2544029

[51] Int. Cl.[2] ..... D01H 5/38; G05B 19/28

[52] U.S. Cl. ..... 318/39; 318/600; 318/604; 19/240

[58] Field of Search ..... 19/240, 602; 318/600, 318/604, 39

[56] References Cited

U.S. PATENT DOCUMENTS 3,795,851 3/1974 Gage et al. ..... 318/602

3,938,223 2/1976 Grice ..... 19/240

FOREIGN PATENT DOCUMENTS 1443258 7/1976 United Kingdom ..... 19/240

*Primary Examiner*—B. Dobeck

*Attorney, Agent, or Firm*—Bailey, Dority & Flint

[57] ABSTRACT

A method and apparatus for automatically leveling a band of fibers such as sliver, roving and the like by varying the drafting speed of a drafting mechanism responsive to variations in the thickness of the band. Analogue signals are produced by variations in the thickness of the band and are converted to digital signals for being stored in a digital register. After a period of time, corresponding with the time for conveyance of the scanned point in the sliver up to and into the draft zone, the information is read out of the storage register and converted back to an analogue signal. The analogue signal is compared with another signal representing the actual drafting speed for producing a compared signal for controlling the drafting speed.

6 Claims, 2 Drawing Figures

METHOD AND DEVICE FOR AUTOMATICALLY LEVELING FLEECES, SLIVERS, ROVINGS AND THE LIKE BY DRAWING

BACKGROUND OF THE INVENTION

The practice is known (West German Pat. No. 1.287.484) of measuring the thickness of the silver before the draft zone and according to the measured values to adjust in the axial direction pins carried on a disc defining a continuous circulating store. The positions of the pins relative to the disc are sensed and corresponding electrical control pulses are generated. The pulses are fed to a control device which alters the ratio of transmission of a taper-roller gearing and thereby the draft ratio of the draft zone in such a way that the silver leaving the draft zone exhibits essentially constant thickness. Such a store provided with pins is, however, suitable only for relatively low draft speeds. But with the high speeds utilized today, satisfactory setting of the pins is not possible since rapid adjustment of the pins leads to throwing, so that no uniform sliver thickness can be achieved.

For higher operating speeds the practice is, however, known of inserting dimensional analogue voltages determined by the scanning, unchanged into an electrical store and recalling them with a phase shift for the control of the separate drive of the draft stage (West German Pat. O/S No. 2 331 217). But such a method is inaccurate since dimensional quantities cannot be stored as unaltered values for long, causing faulty regulation.

As a result of partial discharge of capacitors used in storage devices because of leakage currents in the case of long stoppage times of the machine and by ageing and deterioration, accurate regulation cannot be guaranteed in the case of the known method.

SUMMARY OF THE INVENTION

This problem is solved in accordance with the invention if the deviations of the sliver thickness from the desired thickness and converted into analogue electrical voltages and then converted back into digital values and stored as such. These digital values, after a time corresponding with the time for conveyance of the scanned point in the sliver up to and into the draft zone, are read out of the storage register and converted back into analogue electrical voltages. The analogue voltages are then fed to a control device for regulation of the draft.

Since the electrical voltages corresponding with the fluctuations in sliver thickness are converted into binary numbers, then it is only necessary to record the presence or absence of an electrical voltage in the storage register, the magnitude of the stored values being irrelevant. After read out of the stored binary numbers, they are converted back into analogue voltages which accurately correspond to the analogue values before storage. In this way accurate adaptation of the draft to the fluctuations in the sliver as scanned is achieved, so that a really uniform sliver can be produced.

For performance of the method described, in accordance with the invention a digital-value stepping-storage is provided with an analogue digital converter connected before it and a digital analogue converter connected after it. An impulse generator operating in dependence upon the draft speed is associated with the digital-value stepping-storage. Because of the impulse generator operating in dependence upon the draft speed, the pulse frequency is positively synchronized with the draft speed.

The digital value stepping-storage is in one embodiment a conventional digital shift register.

The impulse generator may be connected to any one of the moving draft members. A particularly accurate result can, however, be achieved if the impulse-generator is connected to the draft member for which the speed is adjustable. In order to utilize the same impulse generator for controlling the drafting of different lengths of fibers upon which the draft point in the draft zone would need to be changed, in accordance with a further feature of the invention an adjusting-gearing is associated with the impulse generator.

Advantageously, the control device is connected control-wise to the draft rollers, and between the digital analogue converter and the control device, a harmonic generator is arranged.

Accordingly, it is an important object of the present invention to provide a method and device for leveling bands of fibers such as fleece, roving, and sliver.

Another important object of the present invention is to provide a leveling device for bands of fibers which can operate at high draft speeds.

These and other objects and advantages of the invention will become apparent upon reference to the following, specification, attendant claims, and drawings.

DESCRIPTION OF THE PREFERRED EMBODIMENT

Figure 1:
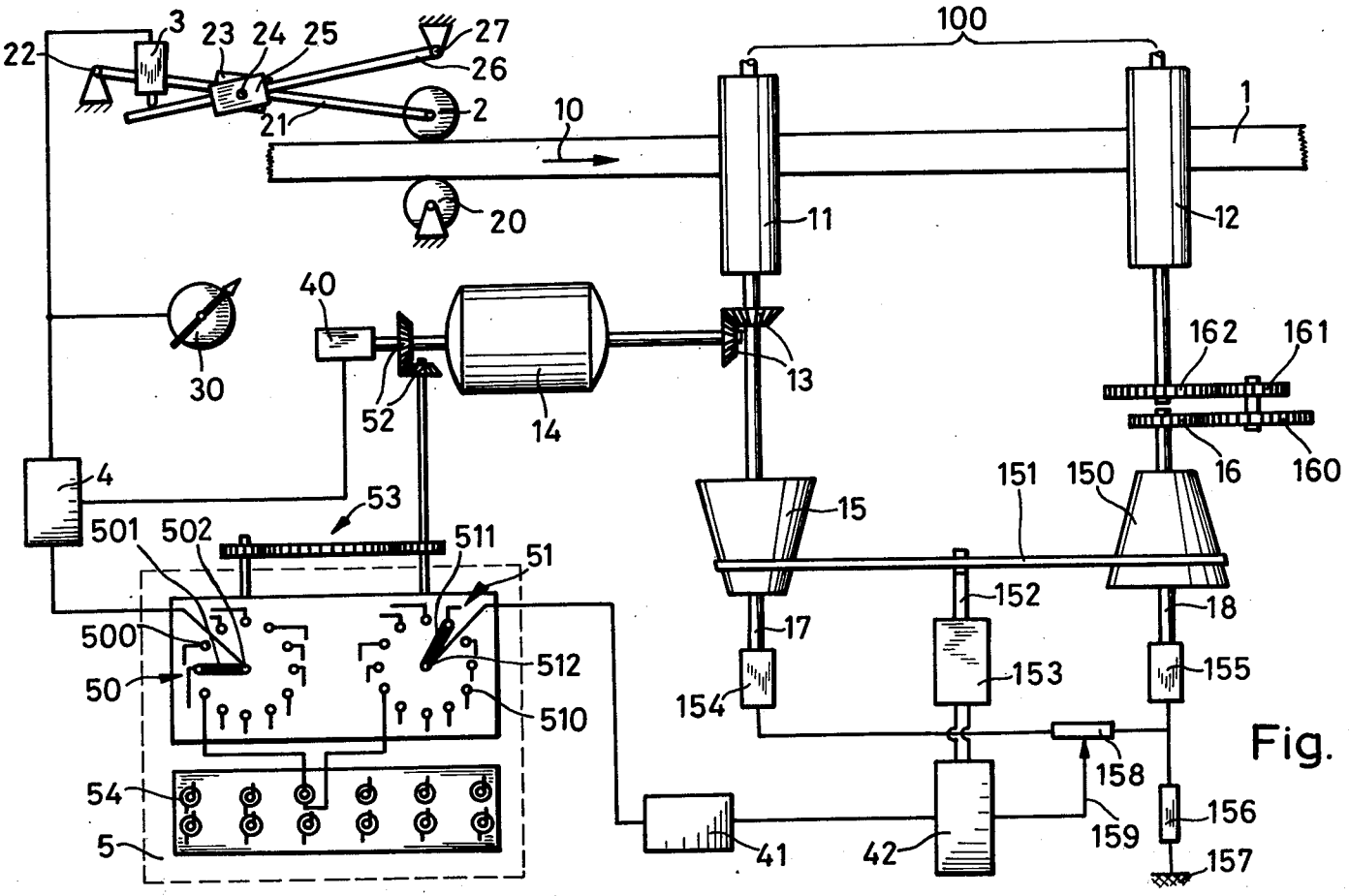
FIG. 1 is a block diagram illustrating an embodiment of the invention for leveling bands of fiber.

In accordance with FIG. 1, a sliver 1 is running in the direction of the arrow 10 through a draft zone 100 which is bound by draft rollers 11 and delivery rollers 12. The draft rollers 11 are driven via a gear 13 from a motor 14. The delivery rollers 12 are driven by the motor 14 via a taper-roller gearing consisting of cones 15 and 150 together with a belt 151 as well as via a control gear consisting of the gearwheels 16, 160, 161 and 162. For alteration of the draft, an adjusting fork 152 is associated with the belt 151, which is controllable by an adjusting electromagnet 153. By varying the electromagnetic force of the electromagnet 153, the position of the fork 152 is varied for adjusting the belt 151 along the cones 15 and 150.

At a distance before the draft zone 100, a scanner is connected. In accordance with FIG. 1, the scanner exhibits a stationary supporting roller 20 as well as a scanner roller 2 arranged at the end of a lever 21. On the lever 21, which is pivotable about an axis 22, an adjustable slide 23 is arranged which carries a pin 24 upon which a second slide 25 is arranged. The second slide 25 is seated on a second lever 26, the pivot 27 of which is arranged at the end of it remote from the axis 22 of the lever 21. By adjustment of the slide 23 along the lever 21, it is possible to adapt the scanner to the medium cross-sectional thickness of the sliver as is explained again in detail later. An electrical measuring device 3 is associated with the lever 26. This may be of various forms, for example, in accordance with one of the solutions shown in the West German Pat. No. 889 987. Thus, the electrical measuring device may exhibit, e.g., a projection (of iron) connected to the lever 26, which depending upon the position of the lever 26, plunges further or less far into a coil, whereby a correspondingly large electrical voltage is generated. This electrical voltage which may be read on a voltmeter 30 is fed to an analogue digital converter 4 which is connected to an pulse generator 40 driven by the motor 14. The output from the analogue digital converter 4 is connected to a stepping-storage 5. The stepping-storage 5 exhibits two stepping-devices 50 and 51 which are driven by the motor 14 via gears 52 and 53. Each stepping-device 50 and 51 exhibits contacts 500 and 510, respectively, arranged in circles which are scanned in succession by an arm 501 and 511, respectively. The center 502 of the arm 501 is connected to the analogue-digital converter 4 while the center 512 of the arm 511 is connected to a digital analogue converter 41. The contacts 500 and 510 are connected in respective pairs to a storage element 54. The connection between the contacts 500 and 510 and the storage elements 54 or the position of the arms 501 and 511 is so formed that each storage element 54 is connected at different times to the analogue digital converter 4 or respectively to the digital analogue converter 41, the timeshift representing the storage time. The storage time, however, is aimed at the time for conveyance of the scanned point in the sliver 1 up to and into the draft zone 100.

A tachometer generator 154 is connected to the cone 15, while another tachometer generator 155 is connected to the cone 150. The tachometer generator 155 is connected to ground 157 via a resistor 156. One end of a potentiometer 158 is connected to the lead between the tachometer generator 155 and the resistor 156 and the other end is connected to the tachometer generator 154. The arm 159 taps off the voltage from the potentiometer 158 and feeds it to an amplifier 42 the second input of which is connected to the digital analogue converter 41. For control of the belt, the amplifier 42 is connected to the adjusting electromagnet 153.

In operation, the draft rollers 11 and the delivery rollers 12 are driven at a certain speed ratio relative to one another in order to achieve a definite draft of the sliver 1. The draft ratio is established by a suitable selection of the gearwheels 16, 160, 161 and 162 and may be altered at will. Alterations of the draft ratio, which becomes necessary because of fluctuations in the thickness of the sliver 1 are automatically performed by adjustment of the belt 151 along the cones 15 and 150. For this purpose, the sliver 1 on its way into the draft zone 100 before reaching the draft rollers 11 is led between the supporting roller 20 and the scanning roller 2. In order to run the belt 151 in a central position on the cones 15 and 150 at the desired thickness of the undrawn sliver 1, so that regulation of the draft which may possibly become necessary is possible through adjustment of the belt 151 in both directions along the cones 15 and 150, the slide 23 is brought into an appropriate fundamental position on the lever 21 and secured in this position.

At the transmission ratio hereby resulting because of the effective leverages of the levers 21 and 26, a certain electrical voltage is generated in the measuring device 3 which can be checked by the permanent or plug-in voltmeter 30. The electrical voltages generated by the measuring device 3 are fed to an analogue digital converter 4. These electrical voltages fluctuate according to the fluctuations in the thickness of the undrawn sliver 1. In the analogue digital converter 4, the electrical voltages are converted into binary numbers at the rhythm determined by the impulse generator 40. The pulse frequency of the impulse generator 40 is dependent upon the speed of the motor 14, and hence, upon the speed at which the sliver 1 is being passed through the draft zone. By suitable selection of the transmission ratio of the gearing 53 for the stepping-storage the time interval between two successive impulses is just as long as the time the arm 501 and 511 needs to get from one contact 500 or 510 to the adjacent contact. By suitable wiring or by arrangement of the arms 501 and 511 appropriately shifted in phase with respect to one another, the binary values delivered by the analogue digital converter 4 storage elements 54 can only be read out when the scanned point in the sliver 1 has reached the draft zone 100. The storage period in the stepping-storage 5 is therefore adjusted to the distance of the scanning roller 2 from the draft rollers 11 and to the speed of conveyance of the sliver 1. The path that the digital signals take from analogue digital converter 4 to digital converter 41 is through center contact 502, arm 501, contact 500, through storage element 54, contact 510, arm 511, through center contact 512 to digital converter 41.

Since the analogue values generated by the measuring device 3 is converted into digital values, loss of stored information when there is a voltage drop is impossible, since it is not voltage values but numerical values that get stored. The storage element 54 is in that case not to be understood as a single element but embraces a plurality of elements or bits for the individual binary numbers 1, 2, 4, 8, 16, 32, etc. the combination of which reproduces the respective electrical quantity.

The pulses released from the stepping-storage 5 after the established storage time are converted back again in the digital analogue converter 41 into electrical quantities. Storage in the form of digital values guarantees that the electrical quantities fed to the analogue digital converter 4 and the electrical quantities released by the digital analogue converter 41 are exactly equally large. This is essential for accurate draft regulation.

The electrical quantities which the digital analogue converter 41 emits are fed to an amplifier 42. In addition, an actual value is advanced to the amplifier 42 which is tapped off by the arm 159 from the potentiometer 158. The potentiometer 158 is preset to correspond with the required draft ratio, the values of voltage corresponding with the r.p.m. at the time, of the shafts 17 and 18 carrying the cones 15 and 150, being generated by the tachometer generators 154 and 155 and fed to the potentiometer 158. Hence, the actual value corresponds with the real draft ratio. The amplifier 42 compares this actual value with the value from the digital analogue converter 41 and actuates the adjusting electromagnet 153 to correspond with possible deviations. The adjusting magnet 153 then adjusts the belt 151 on the cones 15 and 150 by means of the adjusting fork in the direction hereby determined, whereby the draft is altered.

Depending upon the material, it may be desirable if the sliver 1 is drawn at differing speeds. To do this, the speed of the motor 14 and the position of the arm 159 on the potentiometer 158 merely needs to be altered.

Figure 2:
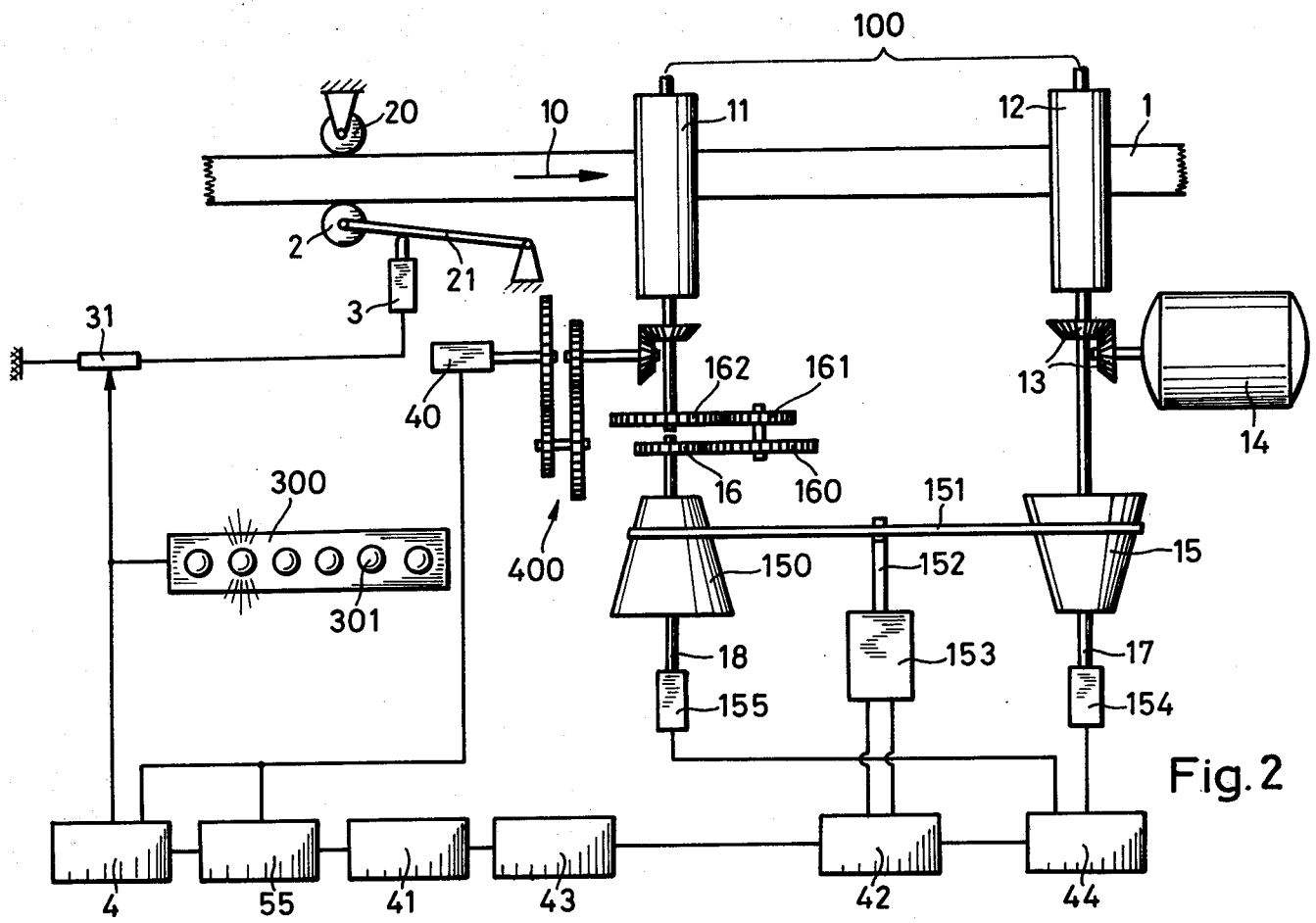
FIG. 2 is a modified form of the invention in diagramatic form illustrating a method and apparatus for leveling bands of fiber.

FIG. 2 illustrates a modified form of the invention in which adaptation to the desired thickness of the sliver to be drawn is effected not by alteration of the transmission ratio of the lever 21 but by means of a potentiometer 31. This potentiometer 31 is set so that the indicator device 30 (FIG. 1) when the thickness of the sliver 1 is at its desired value always indicates a certain electrical quantity. Instead of a voltmeter, a device 300 may also be used which exhibits a certain number of signal lamps or luminous diodes 301 which light up in dependence upon the electrical voltage generated by the measuring device 3. The number of signal lamps or luminous diodes 31 illuminated is, therefore, a dimension of the electrical voltage and thereby of the measured thickness of the sliver 1. This device 300 may be permanent or of plug-in type.

In the case of the embodiment of the invention as shown in FIG. 2, a digital shift register 55 is used as stepping-storage. This is very simple in construction and conveys the stored binary numbers at the rhythm prescribed by the impulse generator 40 through the storage.

Depending upon the length of the fibers in the sliver 1, the actual draft point is shifted in the draft zone 100. While the draft point with shorter fibers lies nearer to the draft rollers 11, with increasing fiber length it moves in the direction of the delivery rollers 12. Hence, also the distance of the scanning roller 2 from the draft point is altered to correspond with the fiber length. In order to take this fact into account, an adjusting gearing 400 may be connected before the impulse generator 40 so that the pulse frequency may be altered correspondingly by alteration of the gear ratio of the adjusting gearing 400. The values stored in the digital shift register 55 are, therefore, shifted at an altered speed through the storage, whereby adaptation of the resultant distance of the scanning point from the draft point is possible. But by selection of a digital shift-register 55 having a number of outputs, it is also possible to select the output corresponding with a certain number of stepping stages in which case the frequency of the impulse generator does not have to be altered.

As a comparison of FIGS. 1 and 2 shows, either the delivery rollers 12 or the draft rollers 11 may be regulated. Hence, the motor 14 acts either on the shaft between the draft rollers 11 and the cone 15 or on the shaft between the delivery rollers 12 and the cone 15.

If the delivery rollers 12 are regulated (FIG. 1) the sliver 1 gets fed to the draft zone 100 always at the same speed, but led away out of the draft zone at variable speed. In accordance with FIG. 2, the sliver 1 is fed to the draft zone 100 at variable speed, but led away from the draft zone 100 at constant speed. If it is also possible as shown in FIGS. 1 and 2 to associate the impulse generator 40 fundamentally with the draft roller side a more accurate result is possible since on that side the impulse generator 40 takes the regulation into consideration. For this purpose, the impulse generator in accordance with a preferred embodiment of the invention is always associated with the draft member, the speed of which is being regulated. In accordance with FIG. 2, the speed of the draft rollers 11 is being regulated; consequently, the impulse generator 40 is being driven in dependence upon the speed of the latter. In the case of the embodiment as FIG. 1, the result of the regulation can be improved if the impulse generator 40 is driven in dependence upon the speed of the delivery rollers 12.

When the draft rollers 11 are regulated in accordance with a further feature of the invention, a harmmonic generator 43 may be arranged between the digital analogue converter 41 and the amplifier which smoothes the electrical voltages to values which are associated with a hyperbolic function. By this means, satisfactory speed regulation of the draft rollers 11 is achieved.

Instead of a potentiometer 158, a divider 44 may also be provided, which automatically delivers from the voltages delivered by the tachometer generators 154 and 155 an actual value which independently of the delivery r.p.m. always corresponds with the draft ratio. This value is passed on to the amplifier 42.

As the foregoing description shows, in accordance with the invention, the deviation of the sliver thickness from the desired thickness is determined in the form of analogue electrical quantities, normally in the form of voltage values. These values before storage are converted into binary values and inserted as binary values in a stepping-storage. Since the essential thing is only which bits are operated in this case but not which value is to be stored in each bit, electrical losses which possibly occur play no part. The binary values released again after a time corresponding with the time of conveyance of the scanned point in the sliver 1 up to and into the draft zone 100 are converted back into analogue values which are unaltered as compared with the corresponding electrical quantities before storage. These electrical quantities are then fed to the control device formed, for example, as an adjusting magnet 153 which then performs an accurate regulation of the draft. Through the accurate reproduction of the electrical voltages, satisfactory regulation of the sliver thickness is achieved, which by adjustment of the frequency of the impulse generator 40 or by alteration of the number of stages in the digital shift-register 55 may be adapted very accurately even to the shift of the draft point because of differing fiber lengths.

The impulse generator 40 is actuated always in dependence upon the motor 14 or a part driven by it, so that it operates always in dependence upon the draft speed. In both of the embodiments, the impulse generator 40 is utilized to synchronize the storage time for the digital signals in the storage register with the drafting speed. Control in dependence upon the network would imply an additional gearing for adaptation to the draft speed.

Naturally, it is also possible instead of the transmission by means of two cones 15 and 150 together with a belt 151 to employ two separate motors for the draft rollers 11 and the deliver rollers 12. The control device would then have to be adapted to correspond with such a driving device. But even in the case of a conical roller, gearing the control device may be of different form, for example, in accordance with West German Pat. No. 1,287,484.

While a preferred embodiment of the invention has been described using specific terms, such description is for illustrative purposes only, and it is to be understood that changes and variations may be made without departing from the spirit or scope of the following claims.

What is claimed is:

1. A device for automatically leveling a band of fibers such as fleeces, slivers, roving and the like by varying the drafting speed of a drafting mechanism, said device comprising:

a. means for sensing the thickness of said band of fibers before said band of fibers are fed into said drafting mechanism and generating an analogue voltage corresponding thereto, b. an analogue to digital converter converting said analogue voltage to a digital signal, c. storage means for storing said digital signal, d. said storage means for storing said digital signal including, i. a digital value stepping storage register, and
ii. means for stepping said storage register in synchronism with said drafting speed, e. means for reading out said stored digital signal from said storage means after a predetermined period of time, f. means for converting said digital signal after being read-out to a converted analogue signal, g. means for varying the drafting speed of said drafting mechanism with said converted analogue signal in order to level said band of fibers, and h. said means for stepping said storage register in synchronism with said drafting speed includes,
i. an impulse generator operably connected to said drafting mechanism for generating pulses having a frequency corresponding to the drafting speed.

2. The device as set forth in claim 1 further comprising a set of gears interposed between said drafting mechanism and said impulse generator for controlling the output frequency of the pulses generated by said impulse generator.

3. The device as set forth in claim 2 further comprising means for adjusting the gear ratio for said set of gears for varying the output frequency of said impulse generator.

4. The device as set forth in claim 1, wherein said drafting mechanism includes a pair of draft rollers and a pair of delivery rollers one of these pair of rollers being adapted to be set for the purpose of leveling said band of fibers, said impulse generator being connected to that pair of rollers of the drafting mechanism which is adapted to be set.

5. A device for automatically leveling a band of fibers such as fleeces, slivers, roving and the like by varying the drafting speed of a drafting mechanism, said device comprising:

a. means for sensing the thickness of said band of fibers before said band of fibers are fed into said drafting mechanism and generating an analogue voltage corresponding thereto, b. an analogue to digital converter converting said analogue voltage to a digital signal, c. storage means for storing said digital signal, d. said storage means for storing said digital signal including,
i. a digital shift register, and
ii. means for stepping said digital shift register in synchronism with said drafting speed, e. means for reading out said stored digital signal from said storage means after a predetermined period of time, f. means for converting said digital signal after being read-out to a converted analogue signal, g. means for varying the drafting speed of said drafting mechanism with said converted analogue signal in order to level said band of fibers, and h. said means for stepping said digital signal through said digital shift register in synchronism with said drafting speed includes,
i. an impulse generator operably connected to said drafting mechanism for generating pulses having a frequency corresponding to the drafting speed, and
ii. means for supplying said pulses to said shift register for shifting said digital signal through said shift register at a predetermined rate.

6. The device as set forth in claim 5, wherein said drafting mechanism includes a pair of drafts rollers and a pair of delivery rollers one of these pairs of rollers being adapted to be set for the purpose of leveling said band of fibers, said impulse generator being connected to that pair of rollers of the drafting mechanism which is adapted to be set.

* * * * *

REEXAMINATION CERTIFICATE (2294th)

United States Patent [19] [11] B1 4,137,487

Niestroj et al. [45] Certificate Issued May 10, 1994

[54] METHOD AND DEVICE FOR AUTOMATICALLY LEVELING FLEECES, SLIVERS, ROVINGS AND THE LIKE BY DRAWING

[75] Inventors: Heinrich Niestroj, Ingolstadt; Peter Denz, Hohenwart, both of Fed. Rep. of Germany

[73] Assignees: Schubert & Salzer, Ingolstadt, Fed. Rep. of Germany

Reexamination Request:

No. 90/003,151, July 30, 1993

Reexamination Certificate for:

| | |
|---|---|
| Patent No.: | **4,137,487** |
| Issued: | **Jan. 5, 1994** |
| Appl. No.: | **726,737** |
| Filed: | **Sep. 27, 1976** |

[51] Int. Cl.[5] ..... D01H 5/38; G05B 19/27

[52] U.S. Cl. ..... 318/19

[58] Field of Search ..... 19/240; 318/39; 318/600; 318/604, 39

[56] References Cited

U.S. PATENT DOCUMENTS

| | | |
|---|---|---|
| 2,930,084 | 3/1960 | Sanborn et al. . |
| 2,964,803 | 12/1960 | Robinson . |
| 2,981,986 | 5/1961 | Neil . |
| 3,244,863 | 4/1966 | Peterson . |

FOREIGN PATENT DOCUMENTS

| | | |
|---|---|---|
| 779197 | 7/1957 | Great Britian . |
| 779346 | 1/1965 | Great Britian . |
| 1287484 | 9/1969 | Germany . |
| 1408755 | 7/1965 | France . . |
| 1436029 | 5/1976 | Great Britian . |
| 2331217 | 1/1975 | Germany . |

*Primary Examiner*—Bentsu Ro

[57] ABSTRACT

A method and apparatus for automatically leveling a band of fibers such as sliver, roving and the like by varying the drafting speed of a drafting mechanism responsive to variations in the thickness of the band. Analogue signals are produced by variations in the thickness of the band and are coverted to digital signals for being stored in a digital register. After a period of time, corresponding with the time for conveyance of the scanned point in the sliver up to and into the draft zone, the information is read out of the storage register and converted back to an analogue signal. The analogue signal is compared with another signal representing the actual drafting speed for producing a compared signal for controlling the drafting speed.

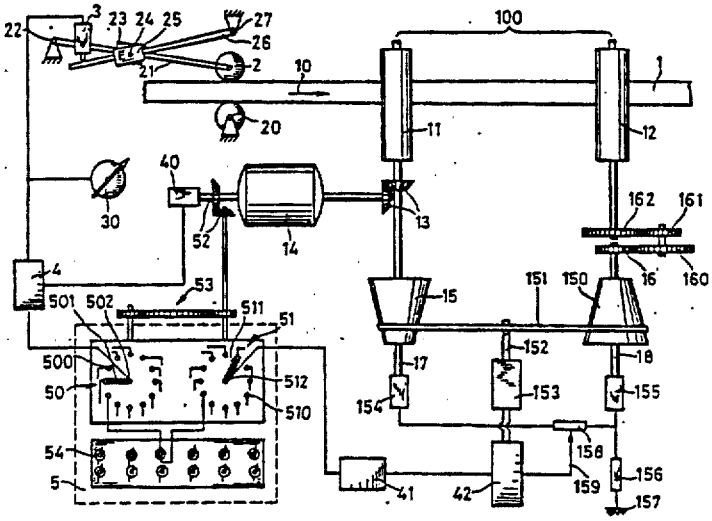

REEXAMINATION CERTIFICATE ISSUED UNDER 35 U.S.C. 307

NO AMENDMENTS HAVE BEEN MADE TO THE PATENT

AS A RESULT OF REEXAMINATION, IT HAS BEEN DETERMINED THAT:

The patentability of claims 1–6 is confirmed.